US008330377B2

(12) United States Patent
Marson

(10) Patent No.: US 8,330,377 B2
(45) Date of Patent: Dec. 11, 2012

(54) MONITORING VOLTAGE TO TRACK TEMPERATURE IN SOLID STATE LIGHT MODULES

(75) Inventor: Jonathan L. Marson, Hillsboro, OR (US)

(73) Assignee: Phoseon Technology, Inc., Hillsboro, OR (US)

( * ) Notice: Subject to any disclaimer, the term of this patent is extended or adjusted under 35 U.S.C. 154(b) by 293 days.

(21) Appl. No.: 12/635,646

(22) Filed: Dec. 10, 2009

(65) Prior Publication Data

US 2011/0140608 A1 Jun. 16, 2011

(51) Int. Cl.
*H05B 37/02* (2006.01)

(52) U.S. Cl. ..... 315/127; 315/86; 315/113; 315/291; 315/308; 362/373; 362/547

(58) Field of Classification Search ..... 315/86, 315/113, 127, 291, 308; 362/373, 547
See application file for complete search history.

(56) References Cited

U.S. PATENT DOCUMENTS 3,784,844 A 1/1974 McGrogan, Jr.
5,936,353 A 8/1999 Triner et al.
6,683,421 B1 1/2004 Kennedy et al.
7,290,903 B2 * 11/2007 Tai et al. ..... 362/373
2005/0230600 A1 10/2005 Olson et al.
2006/0012349 A1 1/2006 Allen
2006/0220571 A1 * 10/2006 Howell et al. ..... 315/86
2006/0233501 A1 10/2006 Sampson
2007/0040512 A1 2/2007 Jungwirth et al.
2007/0108843 A1 * 5/2007 Preston et al. ..... 307/112
2007/0230954 A1 * 10/2007 Sakai et al. ..... 398/12
2008/0116818 A1 * 5/2008 Shteynberg et al. ..... 315/192
2009/0021185 A1 * 1/2009 Ng ..... 315/294

* cited by examiner

*Primary Examiner* — Douglas W Owens
*Assistant Examiner* — Thai Pham
(74) *Attorney, Agent, or Firm* — Alleman Hall McCoy Russell & Tuttle LLP

(57) ABSTRACT

An illumination system has a lighting module, a microcontroller electrically connected to the lighting module and arranged to control the lighting module, and a transistor electrically connected to the lighting module and the microcontroller arranged to allow the microcontroller to monitor a voltage of one of either the transistor or lighting module. A method of controlling a lighting module including powering on the lighting module, providing a current to the lighting module, wherein the current is determined by a global intensity setting for the lighting module, monitoring a voltage provided to the lighting module, and shutting the lighting module down if the voltage reaches a pre-determined level.

17 Claims, 2 Drawing Sheets

MONITORING VOLTAGE TO TRACK TEMPERATURE IN SOLID STATE LIGHT MODULES

BACKGROUND

Ultraviolet (UV) curing has many applications in printing, coating and sterilization. UV-sensitive materials generally rely upon a particular amount of energy in the form of UV light to initiate and sustain the curing process (polymerization) within the materials. UV light fixtures, commonly known as UV lamps, provide the UV light to the materials for curing.

Using arrays of light emitting diodes (LEDs) in UV curing has several advantages over using arc lamps, including lower power consumption, lower cost, cooler operating temperatures, etc. Generally, the arrays consist of individual LED elements arranged in an X-Y grid on a substrate.

While solid state lighting sources generally operate at cooler temperatures than the traditional arc lamps, some issues with thermal management exist. The useful lifetime of LEDs are significantly affected by their junction temperature. In certain situations the cooling system of the LEDs may fail catastrophically and unless power applied to the LEDs is immediately removed, the junction temperature may reach a level that causes significant and permanent degradation to the module or may even cause the light module to fail. Typically, a thermal switch of some kind may be mounted on the package of a solid state lighting module. When the operating temperature of the module reaches a certain level, the thermal switch interrupts the flow of power to the module to avoid damaging the module. The problem with a thermal switch is that it must be placed very near the LED to quickly recognize a cooling system failure. This forces the light module designer to sacrifice good design for the sake of safety and in some cases renders the light module ineffective. More generally there is a compromise which relegates the physical position of the thermal switch to a location generally removed from the LEDs which causes a significant lag in the time at which the LEDs experience a very high temperature and the time which the thermal switch can respond to that temperature increase, potentially causing significant degradation to the light module. This problem is drastically more important in the field of solid state UV curing where LEDs are operated at relatively high power levels and thus reducing the time between losing cooling and light module failure, making the thermal switches even more important.

DETAILED DESCRIPTION OF THE EMBODIMENTS

Figure 1:
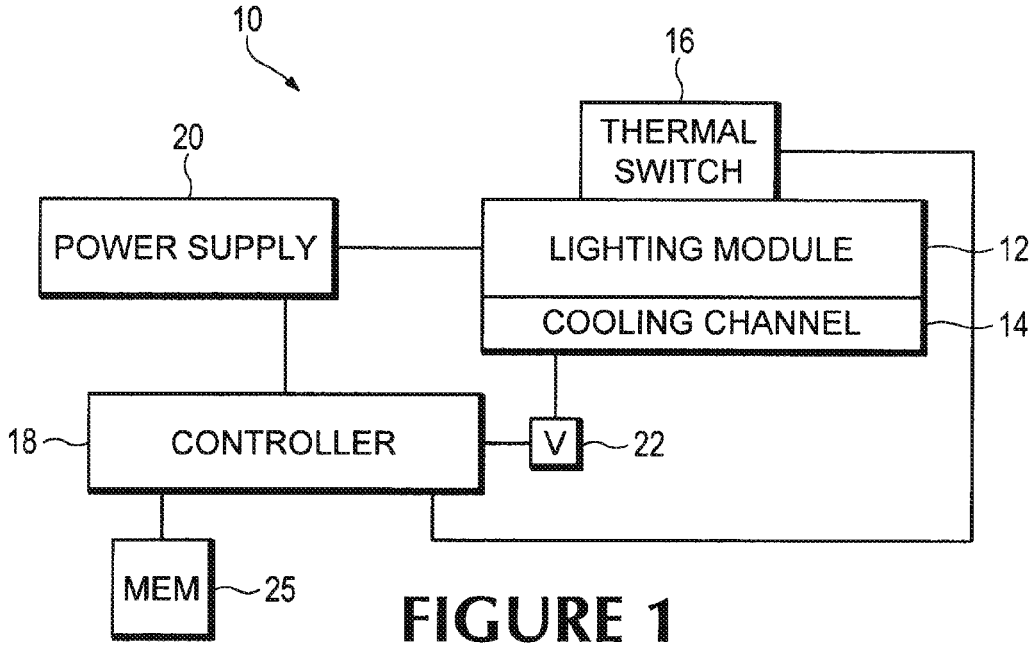
FIG. 1 shows an embodiment of a lighting system.

FIG. 1 shows an illumination system 10 including a lighting module 12, a controller 18 electrically connected to the lighting module and a voltage sensor 'V" 22 electrically connected to the lighting module and the controller. The lighting module may have a cooling channel such as 14 that provides some sort of cooling mechanism to the lighting module. These mechanisms may include air cooling, fluid cooling such as water, a heat sink, etc.

The lighting module may also have a thermal switch 16 that operates to shut off the lighting module when the temperature gets too high.

The controller of the system may be any type of programmable device, such as a microcontroller, digital signal processor, general purpose processor, field programmable gate array, application specific integrated circuit, firmware operating in any one of these, etc. as examples. The controller operates the lighting module including control of the power supply, monitors the voltages at the voltage sensor 22, and stores information in the memory 25. The memory may be any type of memory, including dynamic random access memory (DRAM), static random access memory (SRAM), non-volatile memory, and may be organized into look up tables or as a database.

Figure 2:
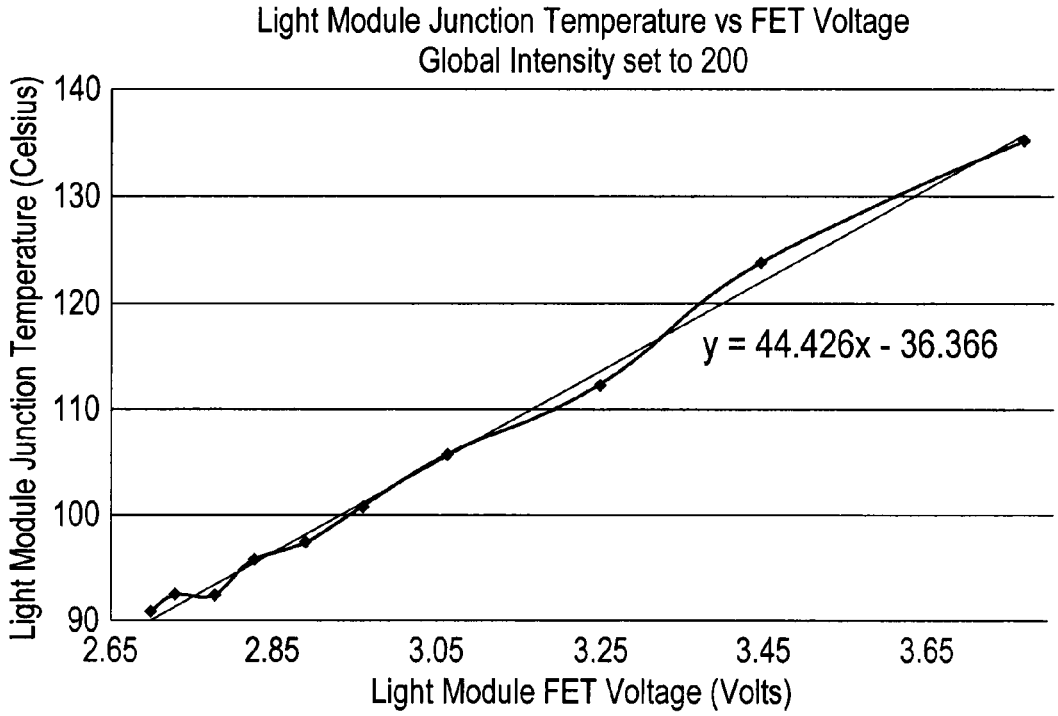
FIG. 2 shows a graph of lighting module junction temperature over FET voltage.

In the system of FIG. 1, a voltage monitor or sensor 22 monitors the voltage provided to the lighting module or sensing the voltage and reports it back to the controller 18. Experiments have shown that the voltage provided to the lighting module at a constant current varies in relation to the temperature of the lighting module. An output graph of one such experiment is shown in FIG. 2.

In the experiment, an array of light emitting diodes, such as the Silicon Light Matrix™ of Phoseon Technology, Inc. having a water-cooled channel was used. No limitation to any particular array of light emitting elements, such as LEDs, laser diodes, etc., is intended nor should any be implied. The lighting module was powered up and the desired current to the lighting module was set to a constant value. The voltage required to maintain that current was monitored while the coolant was adjusted to control the temperature of the lighting module.

In this experiment, the lighting module shows a clear response in voltage at constant current corresponding to changes in the lighting module junction temperature. The voltage monitor or sensor 22 reported a change in voltage from 2.7 to 3.8 volts as the lighting module junction temperature changed from 91 to 135 degrees Celsius. The results are shown in FIG. 2. This relationship may be better expressed by an equation:

$$(V_{f2}-V_{f1})/(T_2-T_1)=m,$$

where $V_{f2}$ is the forward voltage reported by the voltage monitor or sensor 22 when the lighting module is operating and $V_{f1}$ is the forward voltage found by using the relationship $V_f=Ae^{B*(Pot\ 0\ Value)}$. The Pot 0 Value is the intensity setting on the global intensity controller, discussed in more detail later, which in this experiment takes the form of a potentiometer that is used to control the current and therefore the intensity of the lighting module. The variable 'm' is a constant that is an intrinsic physical constant determined by the design of the light module which has its foundation in the LED construction, and $T_1$ is the temperature at checkout.

In order to determine the temperature during operation then, one can rearrange the formula to find $T_2$ as below:

$$T_2=(V_{f2}-V_{f1})/m+T_1.$$

This relationship uses the voltage of the sensor to determine the temperature of the lighting module during operation.

Figure 3:
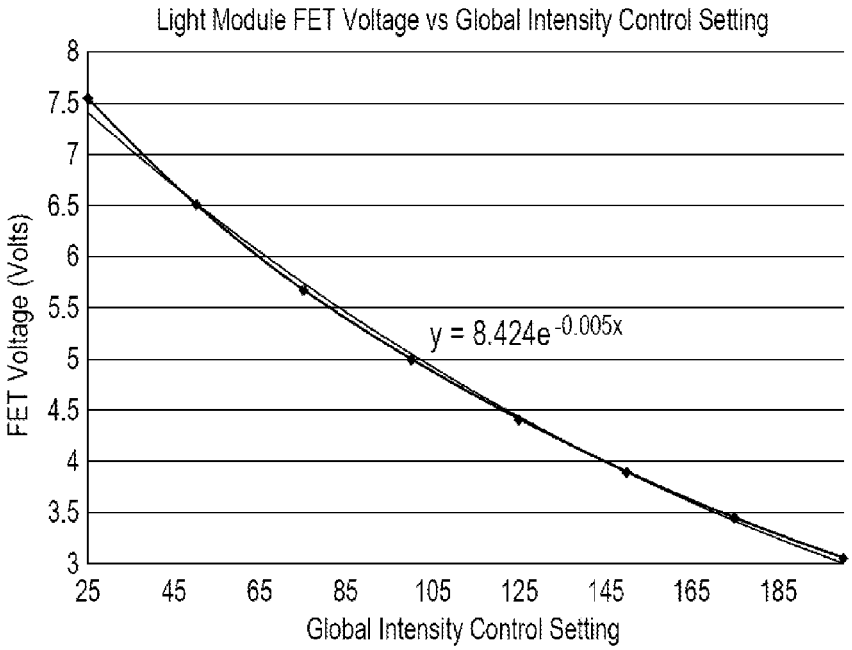
FIG. 3 shows a graph of the lighting module FET voltage over the global intensity setting.

FIG. 3 shows a graph of sensor voltage, in this case a FET, against an intensity control setting, in this case a global potentiometer. This data would be gathered, stored, and referenced by the controller during operation to calculate $V_{f1}$ at any global intensity control setting.

Having established this relationship, it is possible to monitor a voltage to a voltage sensor, such as the FET in the experiment above, and compare it to calculated voltage values to determine the relative difference in the operating temperature. When the voltage reaches a certain level, the controller may shut down the lighting module to avoid degradation and wear and tear. This provides a stronger signal and a faster response than the thermal switch.

Figure 4:
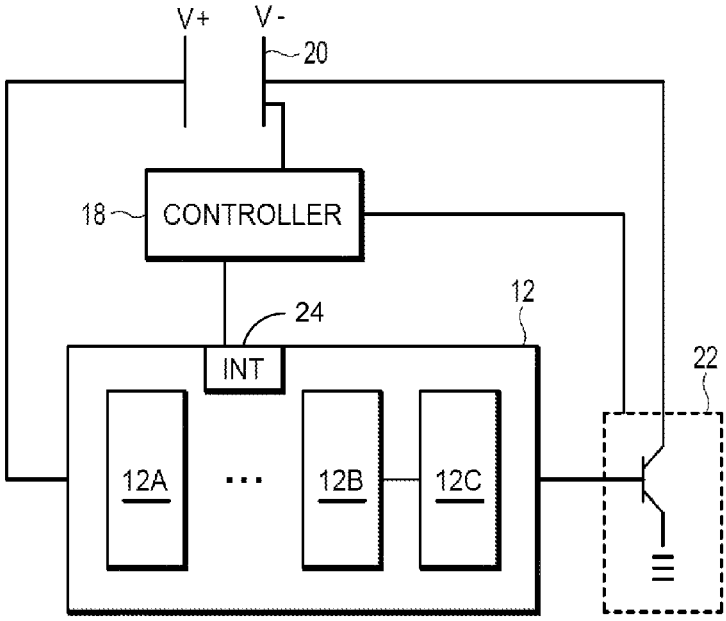
FIG. 4 shows a schematic diagram of an embodiment of a voltage monitoring circuit.

An embodiment of a monitoring circuit is shown in FIG. 4. In FIG. 4, the power supply 20 provides power to the lighting module 12. The lighting module 12 may consist of at least one array of lighting elements arranged in an X-Y grid. The lighting module shown in FIG. 4 has several arrays set in one fixture to act as one lighting source. Each array 12A, 12B, 12C, etc., may have their own intensity control. Generally, the lighting module will have an intensity control 24 that controls the power to all of the arrays in the lighting module and is referred to here as the global intensity control. In the case of there being only one array in the module, the global intensity control may be the intensity control for that one array.

In the embodiment used in the experiment above, the intensity control took the form of a global potentiometer that regulates the power to the arrays, thereby regulating the resulting intensity of the light emitted by the elements. Other options are of course possible and no limitation to any particular form of intensity control is intended nor should any be implied.

In gathering the data during checkout and populating the memory with corresponding voltages and temperatures, if used, the look up table or database may be organized around the intensity control settings, as that will affect the voltages used in the system.

Returning to FIG. 4, the controller 18 monitors the voltage at the voltage sensor 22, in this embodiment a FET. The controller may access a look up table or other data structure to determine the corresponding temperature to the detected voltage. When or if the detected voltage reaches a level corresponding to a temperature level that is too high, the controller would shut down the lighting module. This prevents both degradation of illumination coming from the lighting module and also wear and tear on the lighting module and the elements.

In summary, implementation of the embodiments of the invention results in a voltage sensor or detector being used to allow the controller to monitor the voltage being provided to a lighting module. A relationship between the voltage and the junction temperature of the lighting module is determined and data corresponding to this relationship is stored. The controller can then monitor the voltage level and determine whether or not it has exceeded a particular level, indicating that the lighting module has overheated and needs to be shut down. This signal is stronger and has a faster response time than the heat monitoring done by most thermal switches.

Thus, although there has been described to this point a particular embodiment for a method and apparatus to monitor voltages to track temperature in solid state lighting modules, it is not intended that such specific references be considered as limitations upon the scope of this invention except in-so-far as set forth in the following claims.

What is claimed is:

1. An illumination system, comprising:

a lighting module;

a power supply electrically connected to provide power to the lighting module as a constant current;

a microcontroller electrically connected to the lighting module and arranged to control the lighting module;

a voltage sensor; and a transistor electrically connected in series between the lighting module and the power supply, the transistor including an output apart from a connection to the power supply and a connection to the lighting module to allow the microcontroller to monitor a voltage at either the transistor or the lighting module generated by the constant current via the voltage sensor; and a global intensity control electrically connected to the lighting module so as to allow control of the lighting module.

2. The system of claim 1, further comprising a thermal switch thermally coupled to the lighting module.

3. The system of claim 1, further comprising a memory to store characterization information about the lighting module.

4. The system of claim 3, wherein the memory comprises a look up table.

5. The system of claim 4, wherein the look up table is organized by a setting of a global intensity control.

6. The system of claim 1, wherein the microcontroller is arranged to shut down the lighting module upon a junction reaching a pre-determined level.

7. A method of controlling a lighting module, comprising:

powering on the lighting module;

providing a constant current to the lighting module, wherein the constant current powers a light emitting diode in the lighting module and is determined by a global intensity setting for the lighting module;

monitoring a voltage provided at the lighting module that is generated by the constant current;

converting the voltage to a temperature; and shutting the lighting module down in response to the temperature being greater than a threshold temperature of the lighting module.

8. The method of claim 7, wherein the global intensity setting is changeable.

9. The method of claim 7, wherein monitoring the voltage comprises monitoring a voltage of a transistor coupled in series between the lighting module and a power supply.

10. The method of claim 7, wherein monitoring the voltage comprises using the global intensity setting as an index into a look up table to determine a junction temperature associated with the voltage at the lighting module.

11. The method of claim 10, wherein converting the voltage includes converting the voltage to a power junction temperature.

12. The method of claim 11, wherein the power junction temperature is compared to the threshold temperature and wherein the lighting module is shut down corresponding to the temperature level that is too high based on the comparison of the temperatures.

13. The method of claim 7, wherein the constant current powers an array of light emitting diodes.

14. A method for controlling a lighting module, comprising:

applying a current to an array of light emitting diodes of the lighting module to generate illumination;

generating a voltage at a lighting module junction via the current;

converting the voltage to a junction temperature;

comparing the junction temperature to a threshold temperature of the lighting module; and shutting down the lighting module corresponding to a temperature level that is too high in response to the comparison of the temperatures, wherein a level of current is based on a global intensity setting, the converting of the voltage to the junction temperature being based on the global intensity setting.

15. The method of claim 14, wherein the voltage is monitored via a FET placed in series with the lighting module and a power supply.

16. The method of claim 15, wherein the FET includes an electrical connection to the power supply and an electrical connection to the lighting module, the FET further including an output to a controller, the output apart from the electrical connection to the lighting module and the electrical connection to the power supply.

17. The method of claim 14, wherein the lighting module includes a cooling channel, the array of light emitting diodes arranged in a grid pattern.

* * * * *